US008905234B2

(12) United States Patent
Yoshida

(10) Patent No.: US 8,905,234 B2
(45) **Date of Patent: *Dec. 9, 2014**

(54) MODULE FOR USE IN STACKING THE THIN PLATE PANEL AND METHOD OF STACKING THE THIN PLATE PANEL

(75) Inventor: Kouichirou Yoshida, Tokyo (JP)

(73) Assignee: Kyoraku Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/336,187

(22) Filed: Dec. 23, 2011

(65) Prior Publication Data

US 2012/0163954 A1 Jun. 28, 2012

(30) Foreign Application Priority Data

Dec. 25, 2010 (JP) ..... 2010-289011

(51) Int. Cl.

| | |
|---|---|
| ***B65D 85/30*** | (2006.01) |
| ***B65D 57/00*** | (2006.01) |
| ***B65D 81/05*** | (2006.01) |
| *B65D 85/48* | (2006.01) |

(52) U.S. Cl.

CPC ..... *B65D 57/00* (2013.01); *B65D 81/057* (2013.01); *B65D 85/48* (2013.01)

USPC ..... 206/509; 206/454; 206/586; 206/453

(58) Field of Classification Search

USPC ..... 206/448, 449, 453, 454, 586, 499, 722, 206/322, 509, 511, 512, 503, 712, 710, 206/593; 211/41.1, 41.14, 41.18, 59.4; 220/4.26; 248/345.1; 410/41, 99; 108/27; 150/158; 52/3

See application file for complete search history.

(56) References Cited

U.S. PATENT DOCUMENTS

| | | | | |
|---|---|---|---|---|
| 2,226,601 | A * | 12/1940 | Euller | 206/586 |
| 2,268,458 | A * | 12/1941 | Moore | 34/238 |
| 2,738,564 | A * | 3/1956 | Guinane | 432/259 |
| 3,446,345 | A * | 5/1969 | Frosoy | 206/453 |
| 4,951,821 | A * | 8/1990 | Kempkes | 206/453 |
| 7,350,646 | B2 * | 4/2008 | Durrant | 206/586 |
| 8,109,393 | B2 * | 2/2012 | Haeberlein | 211/41.14 |
| 8,328,020 | B2 * | 12/2012 | Flossmann | 206/586 |

(Continued)

FOREIGN PATENT DOCUMENTS

| | | | |
|---|---|---|---|
| DE | 3701293 A1 | 4/1988 | |
| DK | EP 0270512 A2 * | 8/1988 | B65D 59/00 |

(Continued)

*Primary Examiner* — Anthony Stashick
*Assistant Examiner* — Mollie Llewellyn
(74) *Attorney, Agent, or Firm* — Maine Cernota & Rardin

(57) ABSTRACT

A module for use in stacking plate panels, having: a supporting portion a load transmitting portion, connected to the outside of a supporting portion and a portion for positioning the plate panels horizontally, wherein the load transmitting portion includes receiving surfaces formed on the upper and lower portions of the module, and when the releasing surface of one module is mounted on the receiving surface of a second module, upon stacking the upper module on the lower module, the positioning portion has an upper engaging portion attached to an edge of the receiving surface, and limits a relative movement of the upper module to the lower module, and a lower engaging portion attached to the edge on the same side as the releasing surface on which the upper engaging portion is formed to offset the upper engaging portion, and limits a relative movement of the upper and lower modules.

20 Claims, 9 Drawing Sheets

(56) References Cited

U.S. PATENT DOCUMENTS

| | | | | |
|---|---|---|---|---|
| 2006/0005875 | A1* | 1/2006 | Haberlein | 136/251 |
| 2007/0068882 | A1* | 3/2007 | Yoshizawa | 211/41.18 |
| 2008/0164173 | A1* | 7/2008 | Savakus | 206/454 |
| 2012/0082537 | A1* | 4/2012 | Yoshida | 414/802 |
| 2012/0235004 | A1* | 9/2012 | Belyea et al. | 248/345.1 |
| 2012/0305444 | A1* | 12/2012 | Fujita et al. | 206/701 |

FOREIGN PATENT DOCUMENTS

| | | | |
|---|---|---|---|
| EP | 2196403 | A1 | 6/2010 |
| EP | 2320157 | A2 | 5/2011 |
| JP | 55-007790 | | 1/1980 |
| JP | 2006-032978 | | 2/2006 |
| JP | 2011-216765 | | 10/2011 |
| JP | 2012-025473 | | 9/2012 |
| WO | 2008/105707 | A1 | 9/2008 |

* cited by examiner

MODULE FOR USE IN STACKING THE THIN PLATE PANEL AND METHOD OF STACKING THE THIN PLATE PANEL

RELATED APPLICATIONS

This application claims priority from Japanese Application Number JP2010-289011, filed on Dec. 25, 2010, the content of which is hereby incorporated by reference into this application.

FIELD OF THE INVENTION

The present invention relates to a module for stacking the thin plate panel and a method of stacking the thin plate panel. More specifically, it relates to the method for stacking the thin plate panel using the module where various thin plate panels can be stacked vertically with efficiency and stability.

BACKGROUND OF THE INVENTION

Modules are used for transporting easily breakable heavy thin plate panel i.e. solar panels stored vertically in contact less stacked up form.

Known modules, such as those described in Japanese Open Publication No. 2006-32978 and Open publication no. 55-7790, possess a thin plate panel connected with the support side used for supporting it from lower side and in the state where it is extended from support side. It also possesses the molded material that vertically transmits the weight of thin plate panel. This module also possesses the concave part which mutually gets stuck to top and bottom part of molded material.

According to such modules, the supported thin plate panel can be vertically stacked up without contact. The thin plate panel is put on each support side. Next, in each corner, it is set in the upper concave part of the molded material of the module where the lower concave part of the molded material of a new module has already been arranged.

However, such known modules contain the following technical problems.

First, the uneven positioning part is installed on the top and the bottom of the molded load transmission material to transmit the weight of the thin plate panel up and down. It is difficult to secure a load transmission area large enough for the top and bottom part. Therefore, according to the module, it is possible to support the thin plate panel, in spite of stacking the thin plate panel up and down when pillar shaped module is unstable due to the insufficient load transmission area, and the pillar may collapse by the vibrations while transporting it and the stacked thin plate panel may get damaged.

Secondarily, it is difficult to vertically stack up the multiple thin plate panels with efficiency and stability.

To transport the stacked thin plate panels by the forklift, when the thin plate panels are stacked by using the module on a palette, the thin plate panel cannot be stacked if the module is not positioned at the position that corresponds to each four corners of the thin plate panel on the palette. More concretely, each thin plate panel is put on the support side of the module in each of the four corners. The thin plate panel cannot be supported if the support side of the module is not arranged on each corner by using the state supported from the lower side. At this point, the module is allotted to each four corners of two or more thin plate panels. It is difficult to stack the thin plate panel in the state where the module is allotted to four corners on the palette. Especially, since the module is not fixed to each corner part of the thin plate panel. When four modules like thin plate panels are stacked up at the same time as against the modules that have already been stacked to the pillar-shape on the palette in each corner, the stability of pillar shape module is damaged, and it also destroys the pillar shape module.

Thirdly, making the module compact is a difficult point in relation to the first point.

In detail, especially, from the viewpoint where enough strength is secured to support the total weight of the stacked thin plate panel of the module of lowest level, the load transmission area is decreased by setting uneven part in load transmission area and if the load transmission part is enlarged to increase the load transmission area, though the projection of the module to horizontal direction inevitably grows it is difficult from the viewpoint of maximum storage in limited storage space, without concerning the request of compact module. On the other hand, for a compact module, there is no uneven part in load transmission part and the prevention of a decrease in the load transmission area can be achieved i.e. a vertical board is installed in each top and bottom part of the module. When the module is stacked up, the relative displacement to one direction of inner side or outer side of the module under the upper module can be restricted by locking the lower vertical board of upper module with upper vertical board of lower module.

However, the relative displacement to two directions of inner side and outer side of the module under the upper module cannot be restricted. When the stability of the pillar shaped module is damaged, the pillar shaped module gets destroyed.

SUMMARY OF THE INVENTION

It is an object of the present invention to offer a module used for stacking up the thin plate panel where multiple thin plate panels can be vertically stacked up with stability.

It is another object of the present invention to offer a method of stacking up the thin plate panel where stacking up of multiple thin plate panels can be done vertically efficiently and with stability.

DETAILED DESCRIPTION

Figure 1:
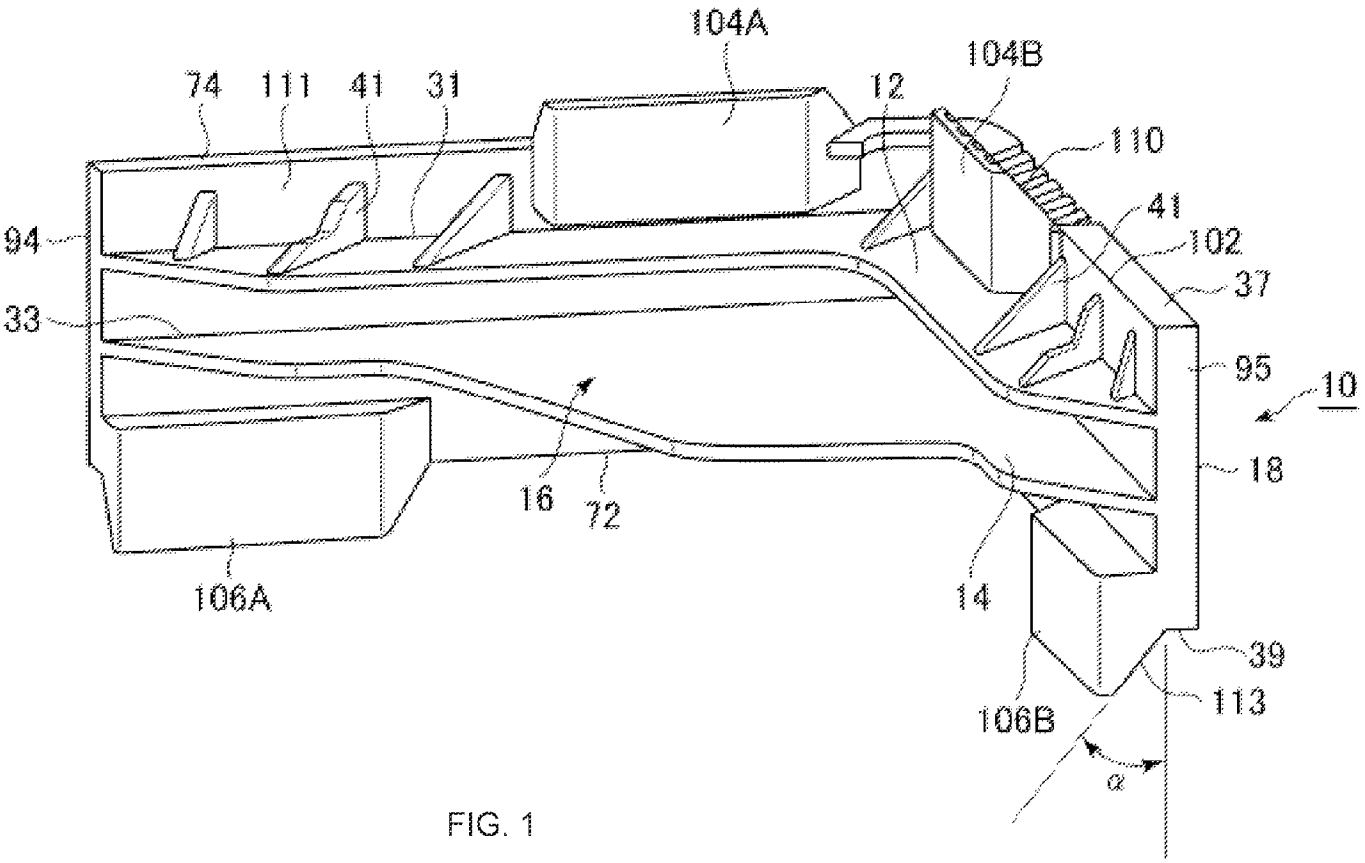
FIG. 1 illustrates total perspective view of upper side of module 10 used to stack solar panel P that lies in the first embodiment of this invention chart.

According to one embodiment of the invention, the module used to stack up the thin plate panel of invention is used for the stacking of the product of the thin plate panel. To solve the problem, the support part for supporting thin plate panel from lower side and the support part outside the support part are connected. It has the load transmission part where the weight of the thin plate panel supported by the support part is vertically transmitted and also it has the positioning portion where thin plate panel is in horizontal direction.

The load transmission part has the load releasing side installed in lower part of this module and also it has the load receiving side installed in the upper part of the module.

When upper module is stacked up on lower module in the state where the load releasing side of upper module is put on the load receiving side of lower module, the positioning portion has the upper engaging portion that limits the relative displacement of the module under the upper module installed on the outer edge and inner edge of the load receiving side and the lower engaging portion that limits relative displacement of the module under upper module installed with the upper engaging portion horizontally offset on the same side of edge where upper engaging portion of the load releasing side is installed.

According, when the upper thin plate panel is stacked on a lower thin plate panel in the state where a load receiving side of the lower module supports a load releasing side of the upper module, as for upper engaging portion installed on inner edge or the outer edge of load receiving side of lower module and lower engaging portion installed on the same side where upper engaging portion on load releasing side of upper module is installed, the upper module can be smoothly put on lower module without knocking against each other since the position is relatively horizontally moved and the offset arrangement is done.

The thin plate panel can be vertically stacked efficiently and stably, without installing the lower engaging portion and the upper engaging portion that composes positioning portion on load releasing side and the load receiving side composing the load transmission part. By separating the load transmission part and the positioning portion, the load transmission is done between upper and lower modules with the load transmission area secured to its maximum. The relative displacement to outer side or inner side of the module under upper module is restricted by upper engaging portion and at the same time relative displacement to outer side or inner side of the module under upper module is restricted by lower engaging portion. Generally, the upper module is horizontally positioned on inner side and outer side of the lower module.

The support part forms a roughly U-shaped cross section by an upper plate and a lower plate and it has a vertical plate where the upper plate and lower plate are connected. The thin plate panel is inserted from open part between the upper plate and the lower plate and it is supported. The load transmission part has the load transfer area formed on the vertical plate. The load receiving side is installed on the upper part of the vertical wall. The load releasing side should be installed under the vertical wall.

Moreover, the upper plate is installed immediately below the bottom of the upper engaging portion. The lower plate is installed immediately above the top of the last engaging portion. The thin plate panel is a panel without the frame in the periphery, and the module supports to each four corners of the panel and it should be directly inserted and supported.

Moreover, the support part is a plate-like body that composes the support side in the upper surface. The thin plate panel is a panel with the frame on the edge and each four corners of the panel should be put on support side through frame in the form that touches inner side of the vertical wall.

In addition, again the upper engaging portion and the lower engaging portion are installed on the outer edge of the load receiving side and the load releasing side respectively. The upper engaging portion limits the relative movement of the upper module towards outside direction of lower module. The last engaging portion should limit the relative movement of upper module towards the inside direction of lower module.

Additionally, the load releasing side should be formed under the vertical wall, on the other hand the load receiving side should be formed on the vertical wall, and the vertical wall should be solid structure. Moreover, the width of the load receiving side and the load releasing side should be 7 mm or less.

The engaging portion has the inclination part that inclines in the state separated to inner side from inner edge of the load receiving side in upward direction from load receiving side.

The engaging portion comprises the inclination part that inclines in the form separated in inner side from inner edge of the load receiving side in downward direction from the load receiving side.

Moreover, the angle of inclination of the perpendicular line of the slope should be ten degrees or thirty degrees. The upper engaging portion and the lower engaging portion should be installed so that it almost covers inner edge or outer edge of the vertical wall.

In addition, the horizontal cross section of the vertical wall should not be L character shape. The upper engaging portion is installed on each side of the intersection part in the L shape load receiving side one by one, and the last engaging portion should be installed on each side of the intersection part on the L shape load releasing side one by one.

Moreover, the upper engaging portion installed on the proximal side in the intersection part in the L shape load receiving side respectively should place the intersection part and be formed continuously.

Additionally, the upper engaging portion is installed on the proximal side of the intersection part in the L shape load receiving side, and the lower engaging portion should be installed on the distal side of the intersection part on the L shape load releasing side.

Moreover, the upper engaging portion and the lower engaging portion should be mutually arranged on each side of the intersection part in the L shape load receiving side.

In addition, the thin plate panel should be a rectangular solar panel.

Moreover, the module is made of the resin, and it would be better to be molded as one mold.

One embodiment of the present invention provides a method of stacking up the thin plate panels with a system configured in accord with an embodiment of this invention, the system comprising a load transfer area in the upper part and lower part. The corner part of the thin plate panel is supported from the lower side and it is connected with the support part. The weight of the thin plate panel is vertically transmitted by the load transmission part and the positioning portion in which the thin plate panel is positioned horizontally by using the engaging portion installed on the edge of the load transfer area. Each two or more thin plate panels have, in each corner, a stage where the thin plate panel is stacked one by one such that vertically stacks of the pillar shaped module vertically transmit the weight of the thin plate panel through the load transmission part. In each corner, the composition of the accumulation stage has the stage where the upper thin plate panel is horizontally positioned on lower thin plate panel through the limitation of a horizontal relative movement of upper module to lower module by the engaging portion between modules that are vertically adjacent.

The support part forms the U-shaped cross section by the lower plate and the upper plate. It should have vertical wall that connects the outer edge of the upper plate and the outer edge of the lower plate. It goes side by side with two or more thin plate panels of the accumulation schedule in front of the accumulation stage. It also has the stage where the module is allotted to each four corners. In this allotment stage, the thin plate part from U-shaped cross section is inserted between the lower plate and the above mentioned upper plate and it also has the stage of insertion and supporting. The stacking stage should have the stage of stacking the thin plate panels one by one where module is stacked up in pillar shape vertically and the weight of thin plate panel through the load transmission part is transmitted vertically in each corner of multiple thin plate panels where four corner modules are allotted.

In addition, the load transfer area has the load releasing side installed in lower part of load receiving side and the vertical wall installed in the upper part of the vertical wall. The engaging portion has the lower engaging portion that limits relative displacement of module of upper module installed where upper engaging portion is horizontally installed offset on the edge of same side towards lower module where upper engaging portion on the load releasing side are installed and also engaging portion that limits the relative displacement of upper module installed in outer edge or inner edge of load receiving side towards lower module. In each corner part, the load releasing side of the upper module is put on the load receiving side of a lower module.

In the positioning stage, the lower engaging portion of upper module should be locked on inner edge of the load receiving side of lower module and also the lower engaging portion of lower module should be locked on outer edge or inner edge of the load releasing side of upper module.

The lower engaging portion has an inclination part that inclines away from the inner edge of the load releasing side downwards from the load releasing side and also the lower engaging portion has an inclination part that inclines away from inner direction from above mentioned inner side of the load receiving side towards upward direction from the load receiving side. The stacking stage should have the stacking stage of upper module on lower module by using the inclination part in the upper engaging portion and the last engaging portion as a guide side.

According to the first embodiment of module 10 of this invention, rectangular solar panel P is a stacked thin plate panel as explained below in detail with reference to the drawings.

Solar panel P connects the cell in the series. It is not thin plate and protected with a resin, tempered glass, or a metallic frame. More concretely, it is a thin plate structure where the cell that consist silicon between a glass layer, a plastic layer or the glass layer. Sunlight panel P has the area of several square meters, the thickness of several mm, and weight of 10 or 30 Kg and it has easily breakable structure.

In this embodiment, the four corners of sunlight panel P where the frame is not installed in rim are directly supported by module 10 used for stacking of the thin plate panel.

Module 10 contains inserted support part that supports solar panel P, the load transmission part where the weight of the thin plate panel connected with the support part from outside and supported by vertically transmitted support part is and the positioning portion which positions in the horizontal direction of solar panel P.

Figure 4:
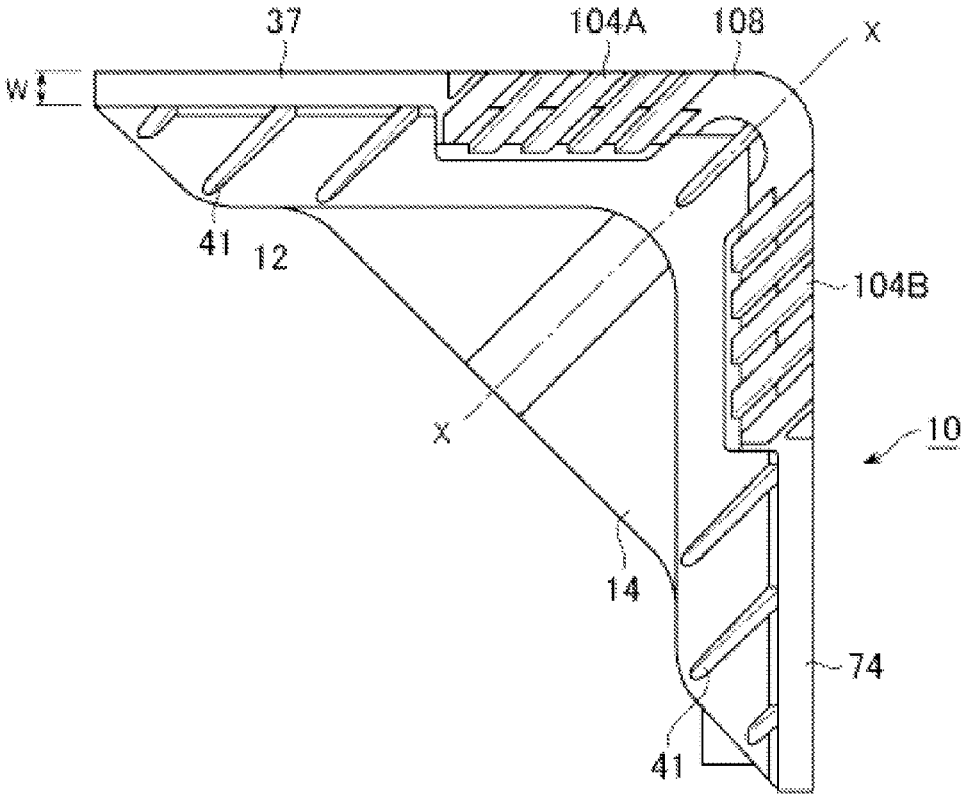
FIG. 4 illustrates ground plan of module 10 used to stack solar panel P that lies in the first embodiment of this invention chart.
Figure 5:
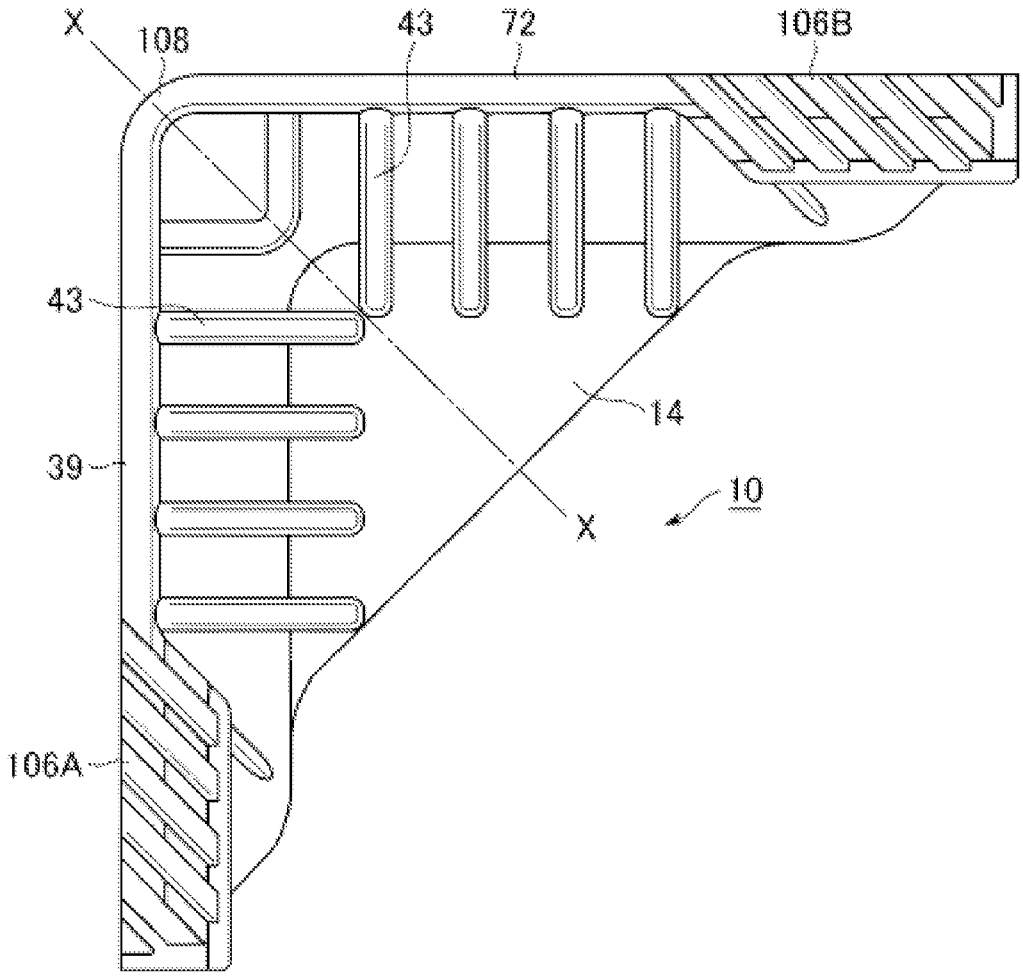
FIG. 5 illustrates bottom view of module 10 used to stack solar panel P that lies in the first embodiment of this invention chart.

Referring to FIG. 1 or FIG. 5, module 10 has the line-symmetric shape for centerline X-X (Refer to FIG. 4). The inserted support part has vertical direction wall 18 that connects upper plate 12, and lower plate 14 and a pair of plate 16 that consists of upper plate 12 and lower palate 14 vertically connected in parallel at intervals. Vertical direction wall 18 composes the load transmission part and module 10 is made up of the resin. This is integral molding. Module 10 is allotted to each of the four corners of solar panel P as explained back in detail, and the following module 10 is put on each module 10 by inserting and supporting panel P. By supporting additional solar panels P, solar panels P are vertically stacked by repeating this.

The weight of each solar panel P is transmitted in each corner through module 10 stacked to the pillar-shaped. The weight of multiple stacked up solar panels P is loaded in lowest module 10.

The resin material of module 10 is a thermoplastic resin. It is Polyolefin (for instance, polypropylene and high-density polyethylene) which are copolymers homopolymer of olefin such as the ethylene, the propylene, the butane, Pentane isoprene, and Methyl pentene of non-amorphous resins etc. such as polyethylene and polypropylenes. Since the structure of module 10 is comparatively complex, it is especially suitable for an integral molding with the injection molding.

Respectively, upper plate 12 and lower plate 14 that composes a pair of plates 16 which will be having an L shape. By upper plate 12 and lower plate 14, especially, as plainly shown in FIG. 1, lower direction walls 18 are installed so that outer edge 31 of upper plate is connected with outer edge 33 of lower plate 14 so that the vertical profiling may form roughly U-shaped section.

Upper plate 12 is fixed on inner side 111 of vertical wall 18 and immediately below lower side of upper engaging portion 104 explained afterwards, and lower plate 14 is fixed on inner side 111 of vertical wall 18 immediately above the upper side of lower engaging portion 106 explained afterwards. It is desirable that upper plate 12 and lower plate 14 are molded by integrated injection molding as a module.

As a result, a pair of plate 16 composes insertion support part that inserts and supports solar panel P and solar panel from open part is inserted between upper plate 12 and lower plate 14.

In this case, by supporting direct trapping solar panel P without a frame in rim, the interval between upper plate 12 and lower plate 14 necessary for jamming support can be reduced as compared with systems using frames. By shortening the upper projection length of lower engaging portion 106 and lower projection length of upper engaging portion 104 as much as possible, the height of module 10 can be lowered. In limited storage space, especially the solar panel P without frame should be kept in the storage space where height is limited. The number of solar panels P can be kept secured.

Each intersection part 108 of upper plate 12 and lower plate 14 is orthogonal. When a solar panel P is trapped and supported, the upper side, lower side and side part of solar panel P are fixed and supported with stability by inner side 111 of vertical wall 18 and upper side of upper plate 12 and lower plate 14 by pushing the corner part of sunlight panel P towards inner side 111 of vertical wall 18 until the side piece of corner part of solar panel P touches inner side 111 of vertical wall 18.

Therefore, the interval between the lower side of upper plate 12 and the upper surface of lower plate 14 and an area of upper plate 12 and lower plate 14 respectively should support panel P. By supporting trapped solar panel P from module 10, and by fixing module 10 with solar panel P, solar panel P can be moved with module 10 allotted to the four corners of sunlight panel P as explained earlier.

Figure 2:
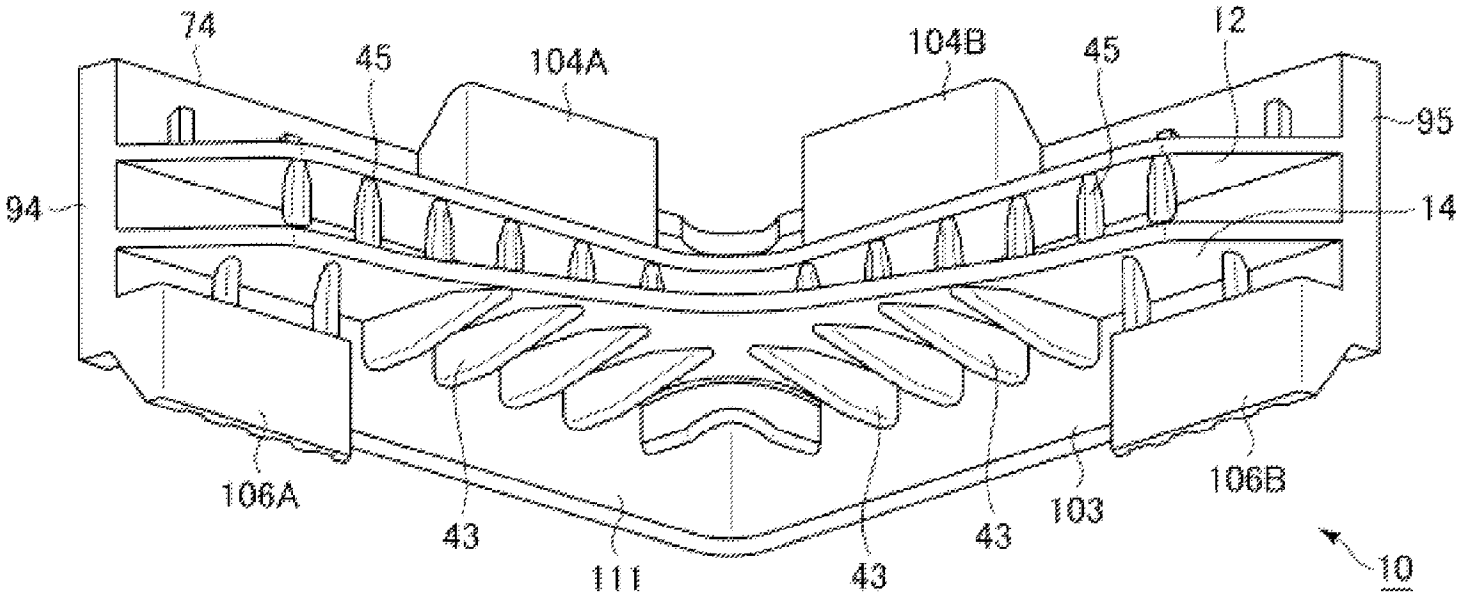
FIG. 2 illustrates total perspective view of lower side of module 10 used to stack solar panel P that lies in the first embodiment of this invention chart.

Reinforcement ribs 41 and 43 are installed in upper plate 12 and lower plate 14 respectively as shown in FIG. 1 and FIG. 2. Especially, when trapped solar panel P is supported, the weight of sunlight panel P is loaded on lower plate 14 and lower plate 14 is supported from the lower side.

As shown in FIG. 1, multiple reinforcement ribs 41 are installed at suitable intervals which are connected in the form where inner side 111 of vertical wall 18 and outer side 111 of upper plate 12 are straddled on upper side of upper plate 12. On the other hand, multiple reinforcement ribs 43 are installed at suitable interval where inner side 111 of vertical wall and lower side of lower plate 14 are straddled on lower side of lower plate 14 as shown in FIG. 2. Number of installations of reinforcement ribs 41 and 43 and the interval should be provided according to the weight of solar panel P of stacking object.

Moreover, as shown in FIG. 2, Guide part 45 with taper is installed at suitable intervals in lower side of upper plate 12 so that it may incline from the viewpoint that facilitates supporting trapped solar panel P so that it inclines in downward direction towards inner side 111 of vertical wall 18. An integrated molding including reinforcement ribs 41 and 43 and guide parts 45 is desirable.

Upper plate 12 and lower plate 14 that are not in L shape can be allotted to the middle part in the each vicinity of solar panel P, and after allotting it to the four corners of solar panel P by using module 10 of L shape, it can be allotted to the middle part by using rectangular module 10. In addition, you may use a part of middle part together with a part of four corners.

Upper and lower sides 37 and 39 of vertical wall 18 compose the load transmission part as shown in FIG. 1 and FIG. 2.

Upper surface 37 and lower side 39 of vertical wall 18 are mutually parallel, and when solar panels P are stacked, lower side 39 forms load releasing side 72 below module 10 while upper surface 37 forms load receiving side 74 above module 10.

Load receiving side 74 and load releasing side 72 both compose the planar section of L shape that reaches from one side of end face 94 of vertical wall 18 to the other end face 95 of other side of vertical direction wall 18. Since an uneven part where the positioning portion is composed is not set on the plane part, the load transmission area can be secured. As a result, making width W of load receiving respect 74 and load releasing side 72 thinner.

In detail, when solar panel P is stacked up, it is desirable to set the thickness below 115 mm or preferably 10 Mm or less since vertical direction wall 18 composes the load transmission part, from the viewpoint to make the thickness thinner as much as possible and enduring the weight of sunlight panel P. Vertical wall 18 is a solid structure. As a result, compacting of the module 10 is then achieved. When the storage space where the solar panel P stacked by module 10 is limited, the number of solar panels P that can be stored can be increased.

Next, as shown in FIG. 1 and FIG. 2, when upper module 10 is stacked on lower module 10 where load releasing side 72 of upper module 10 is put on load receiving side 74 of lower module 10, the positioning portion contains upper engaging portion 104 that limits the relative movement of the upper module 10 to the lower module 10 installed on inner edge of load receiving side 102 and last engaging portion 106 that limits the relative movement of the upper module 10 to the lower module 10 installed on inner edge 103 of same side where upper engaging portion 104 of load releasing side 72 is installed where it is installed offset in horizontal direction to upper engaging portion 104.

Each upper engaging portion 104 is installed on each side of intersection part 108 of L shape load receiving side 74, each one tower engaging portion 106 is installed on each side of intersection part 108 of shape load releasing side 72, and upper engaging portion 104 and lower engaging portion 106 is installed so that it covers inner side 102, 103 of the vertical wall 18 by mutual cooperation. The upper engaging portion 104 is installed on the proximal side of intersection part 108 of L shape load receiving side 74, and lower engaging portion 106 is installed on the distal side of intersection part 108 of L shape load releasing side 72.

Upper engaging portion 104 has inclination part 110 that inclines away from inner direction from inner edge 102 of the load receiving side 74 towards upper direction from load receiving side 74 and it is fixed on inner side 111 of vertical wall 18. When module 10 is stacked as explained back, height H from the load receiving side 74 of the upper engaging portion 104 to the upper side should be properly set so that inner side of lower plate 14 of upper module 10 does not collide, since end part of upper engaging portion 104 of lower module 10 reaches on the way of inner side 111 of vertical wall 18 of upper module 10 (refer to FIG. 6) between vertically adjacent module 10.

Alternatively, lower engaging portion 106 has inclination part 113 that inclines away from inner direction from inner edge 103 of the load releasing side 72 towards lower direction from load releasing side 72 and it is fixed on inner side 111 of vertical wall 18. When module 10 is stacked, height H from the load releasing side 72 of the lower engaging portion 106 to the lower side should be properly set so that upper side of upper plate 12 of lower module 10 does not collide, since end part of lower engaging portion 106 of upper module 10 reaches on the way of inner side 111 of vertical wall 18 of lower module 10 (refer to FIG. 6) between vertically adjacent module 10.

The upper engaging portion 104 and lower engaging portion 106 both have the hollow construction from the viewpoint of light weighted. It is composed of first lateral part opposing almost parallel to vertical wall 18 and each edge of first lateral part and second lateral part and third lateral part extended between inner side 111 of vertical wall 18 and the bottom part where the opening composed by lower edge of the first lateral part, the second lateral part, and third lateral part is closed. In second lateral part and third lateral part, the slope diagonally extended from inner edge is installed and this composes the inclination part. The area of the inclination part can be secured without considering lightening as concrete structure.

When two or more solar panels P are stacked up by using such module 10 as explained back, each four corners of each solar panel P is supported by module 10 beforehand concurrently so that it may become easy to stack for instance by using each solar panel P that allots module 10 to each four corners on the palette. The angle of inclination part 110, 113 ($\alpha$ in FIG. 1) should be properly decided in the range of 0~90 degrees (does not include 0 degrees and 90 degrees) with reference to the height H and it should be 20~70 degrees and further 30~45 degrees. The horizontal positioning function of lower module 10 of upper module 10 decreases though it becomes easy to stack when the angle is larger than 70 degrees. On the other hand, when it is less than 20 degrees, the accumulation becomes difficult though a horizontal positioning function improves.

Figure 6:
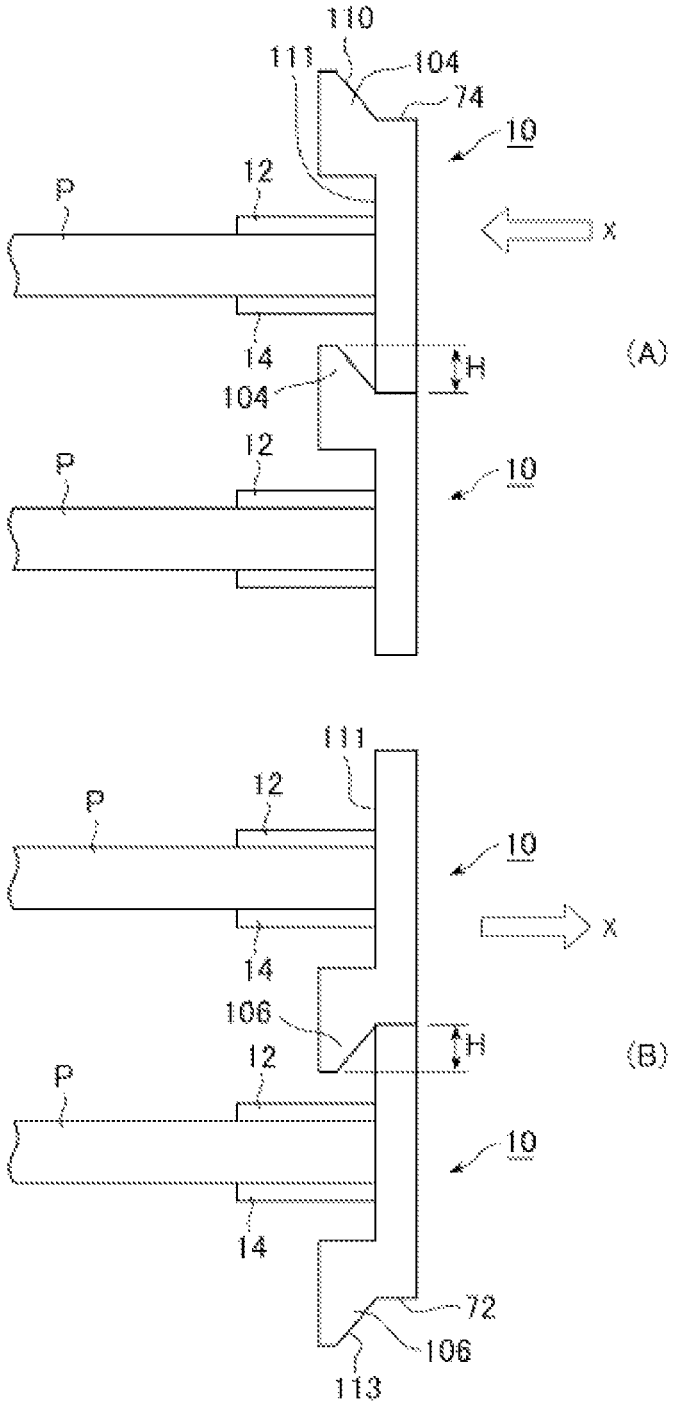
FIG. 6 illustrates Figurematic illustration that shows the function of a lower engaging portion of module 10 used to stack solar panel P that lies in the first embodiment of this invention.

As a result, as shown in FIG. 6, upper engaging portion 104 of lower module 10 limits the relative movement of upper module 10 to inner side of lower module 10 between modules 10 that are vertically adjacent. The relative movement of upper module 10 to inner side and outer side of lower module 10 is controlled since lower engaging portion 106 of upper module 10 limits the relative movement of upper module 10 to outer side of lower module. Thus module 10 can be stacked with stability.

Especially, both upper plate 12 and lower plate 14 are formed to L shape as mentioned above. In each side where intersection part 108 is inserted, upper engaging portion 104 is set on upper plate 12 and lower engaging portion 106 is set on lower plate 14. An orthogonal restriction of two directions on a horizontal plane is possible. More concretely, there is restriction to inner side of orthogonal two directions of lower module 10 of upper module 10. On the other hand, it is restricted outside orthogonal two directions of lower module 10 of upper module 10.

Figure 3:
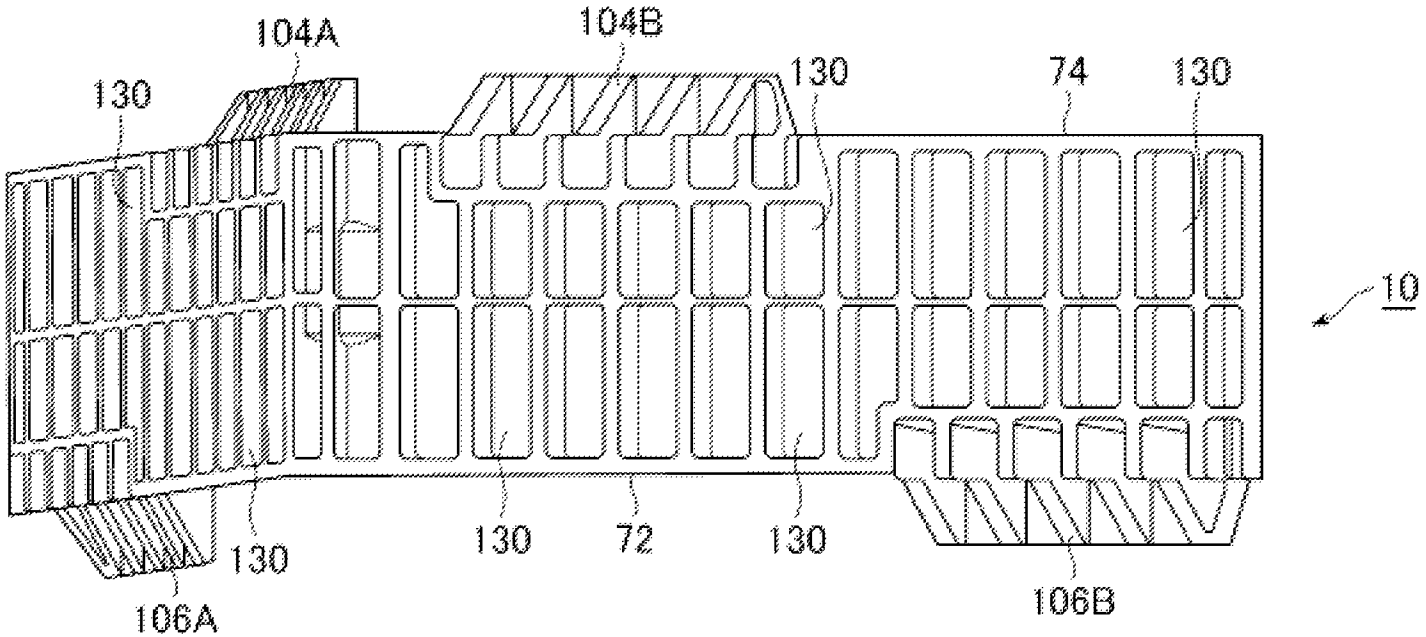
FIG. 3 illustrates total perspective view from outer side of module 10 used to stack solar panel P that lies in the first embodiment of this invention chart.

It is desirable to form the upper engaging portion 104 and lower engaging portion 106 by integrated molding especially the injection molding respectively as module 10. In this case, dent 130 has been installed from the viewpoint of the closing prevention at the time of molding on the outer surface of module 10 as shown in FIG. 3.

According to the composition, upper engaging portion 104 and lower engaging portion 106 are installed on inner side 102 of load receiving side 74 and inner edge 103 of toad releasing side 72 respectively. Compacting of module 10 can be maintained without setting upper and lower engaging portion 106 on toad releasing side 72 and load receiving side 74 having load transfer area and without creating the projection outside module 10.

As the transformation of positioning portion, upper engaging portion 104 installed on proximal side in intersection part 108 in L letterform load receiving side 74 can be formed by continuous insertion of intersection part 108.

More than two upper engaging portion 104 and lower engaging portion 106 is set on each side of intersection pan 108 of L shape load receiving side 74. Upper engaging portion 104 and lower engaging portion 106 can be mutually arranged.

In addition, when compacting of module 10 is not necessary, the upper engaging portion 104 and lower engaging portion 106 are installed on the outer edge of load receiving side 74 and load releasing side 72 respectively. Upper engaging portion 104 of lower module 10 limits the relative movement of upper module 10 to the outer side of lower module 10. Lower engaging portion 106 of upper module 10 limits the relative movement of upper module 10 to inner side of lower module 10.

The application of the module with above composition is explained below through the explanation of vertical stacking method of solar panel P using module 10.

Two or more sunlight panels P are vertically stacked and solar panel P is vertically stacked on upper surface of palette for transporting it by forklift. It is explained with an example.

First of all, module 10 is concurrently allotted respectively in each four corners for two or more sunlight panels P of the stacking schedule. In detail, solar panel P is inserted from the open part of module 10 between lower plate 14 and upper plate 12. Module 10 is fixed to solar panel P by inserting solar panel P.

Corner part of solar panel P moves toward inner side 111 of vertical wall 18, by pushing the corner part of solar panel P towards inner side 111 of vertical wall 18 until it connects where lateral part of angle part of solar panel P is stuck to inner side 111 corresponding to vertical wall 18, lateral part, lower side and upper part of corner part of solar panel P is fixed, supported with stability by inner side 111 corresponding to vertical wall 18 and upper side of lower plate 14 and lower side of upper plate 12.

Such a process is concurrently carried out for each solar panel P. In the palette, efficient solar panel P can be stacked by omitting the process of allotting module 10 to the four corners of solar panel P and by preparing solar panel P in the state where module 10 is allotted to four corners.

Next, two or more sunlight panels P of two or more sunlight panels P that allot module 10 to four corners are stacked one by one in the form that stacks module 10 to the pillar-shaped in each corner.

Load releasing side 72 of L shape of the following module 10 is stacked and new solar panel P is stacked from the upper side to load receiving respect 74 of L shape of module 10 in the uppermost part on the palette in each corner. In that case, inclination part 113 of lower engaging portion 106 of load releasing side 72 of the following module 10 and inclination part 110 of upper engaging portion 104 of load receiving side 74 of module 10 in the uppermost part accomplishes the guide function. The stacking work of the following module 10 can be easily carried out.

Though lower engaging portion 106 of load releasing side 72 of following module 10 and upper engaging portion of load receiving side 74 of module 10 of lowest part is set on inner edge 102, 103 side, since the offset arrangement is mutually done, the following module 10 can be put on module 10 in the uppermost part without striking and without causing the outside projection of module 10 along with set up of the above lower engaging portion 104,106.

When you stack sunlight panel P to sunlight panel P of the uppermost part, four modules 10 allotted to each four corners of sunlight panel P though module 10 in the corresponding uppermost part will be positioned at the same time. Such work can be done more easily by setting the angle of inclination $\alpha$ of inclination part 110 of upper engaging portion 104 and inclination part 113 of lower engaging portion 106 properly.

Figure 7:
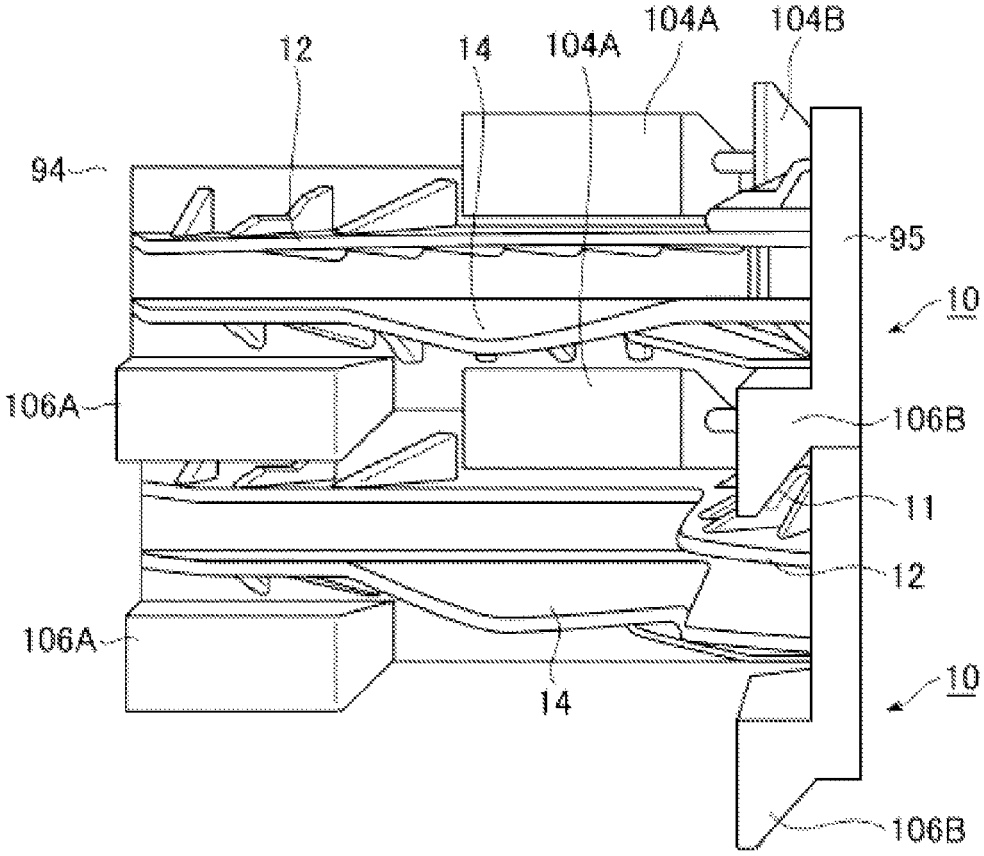
FIG. 7 illustrates partial outline Figure showing the state of stacked module 10 used to stack solar panel P that lies in the first embodiment of this invention.

As shown in FIG. 7, by repeating the work, two or more solar panels P can be vertically stacked by stacking multiple module 10 in each four corners of multiple solar panel P. At this time, in modules 10 that are vertically adjacent, horizontal relative movement of upper module 10 to outer side of lower module 10 is controlled by touching inclination part 110 of lower engaging portion 106 of upper module 10 to inner edge of load receiving side 74 of lower module 10 from inner side. On the other hand, by touching the inclination part 110 of upper engaging portion 104 of lower module 10 to inner direction on inner edge 103 of load releasing side of upper module 10, and by controlling the horizontal relative movement of upper module 10 is towards inner direction of lower module 10. Generally, the relative movement to the outer side and inner side of the upper module 10 to the lower module 10 is controlled.

Especially, upper plate 12 and lower plate 14 are in L shaped. Solar panel P can be vertically stacked efficiently and stably since upper engaging portion 104 allotted to upper plate 12 and lower engaging portion 106 allotted to lower plate 14 is installed on each side where intersection part 108 is inserted and upper module 10 is surely horizontally positioned on lower module 10 by controlling the mutual orthogonal horizontal movement.

Figure 8:
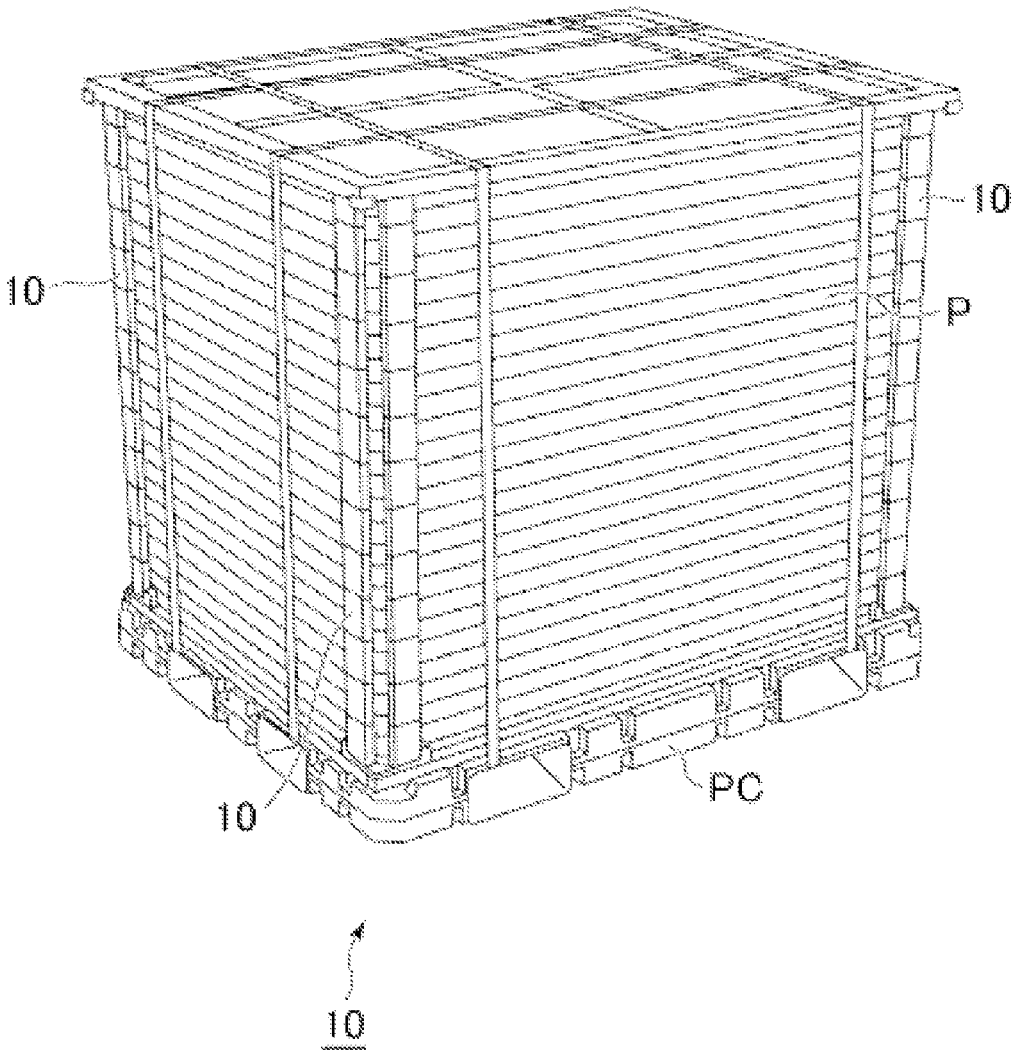
FIG. 8 illustrates total perspective view showing completed stacked solar panel P on palette by using module 10 used to stack solar panel P that lies in the first embodiment of this invention.

Next, for instance by the forklift as shown in FIG. 8, each palette of lowest edge is transported with two or more solar panels P vertically stacked. Solar panel P can be kept in a prescribed place while stacked.

When stacked solar panel P is unpacked, it is done in reverse order of stacking and unpacking can be done efficiently. Module 10 was allotted to four corners. Module 10 should be concurrently detached from multiple solar panels P in different locations and solar panel P is unpacked from palette.

According to module 10 used for the stacking of the product of the thin plate panel that has the composition. When upper thin plate panel is stacked on lower thin plate panel in the state where load releasing side 72 of upper module 10 is placed on load receiving side 74 of lower module 10, module 10 can be smoothly put on lower module 10 without striking each other since horizontal offset arrangement of upper engaging portion 104 installed on inner edge 102 or outer edge of load receiving side 74 of lower module 10 and lower engaging portion installed on same side where upper engaging portion 104 of load releasing side 72 of upper module 10 is done. Moreover, neither upper engaging portion 104, composing the positioning portion, nor lower engaging portion 106 is installed on load releasing side 72; and load receiving side 74 composing load transmission part of the thin plate panel can be vertically stacked efficiently and stably by separating the load transmission part and the positioning portion. The load transmission is done between upper and lower modules 10 with the load transmission area secured to its maximum. At the same time as the relative displacement to inner direction or outer direction of lower module 10 of upper module 10 is limited by upper engaging portion 104 of lower module 10. The relative displacement to outer direction or inner direction of lower module 10 of upper module 10 is limited by lower engaging portion 106 of upper module 10. Generally, upper module 10 is horizontally positioned in inner direction and outer direction of lower module 10.

Second embodiment of this invention in detail is as follows.

In the following explanations, the explanation is omitted by fixing a similar reference number in the components similar to first embodiment. It explains the feature of this embodiment in detail.

Figure 9:
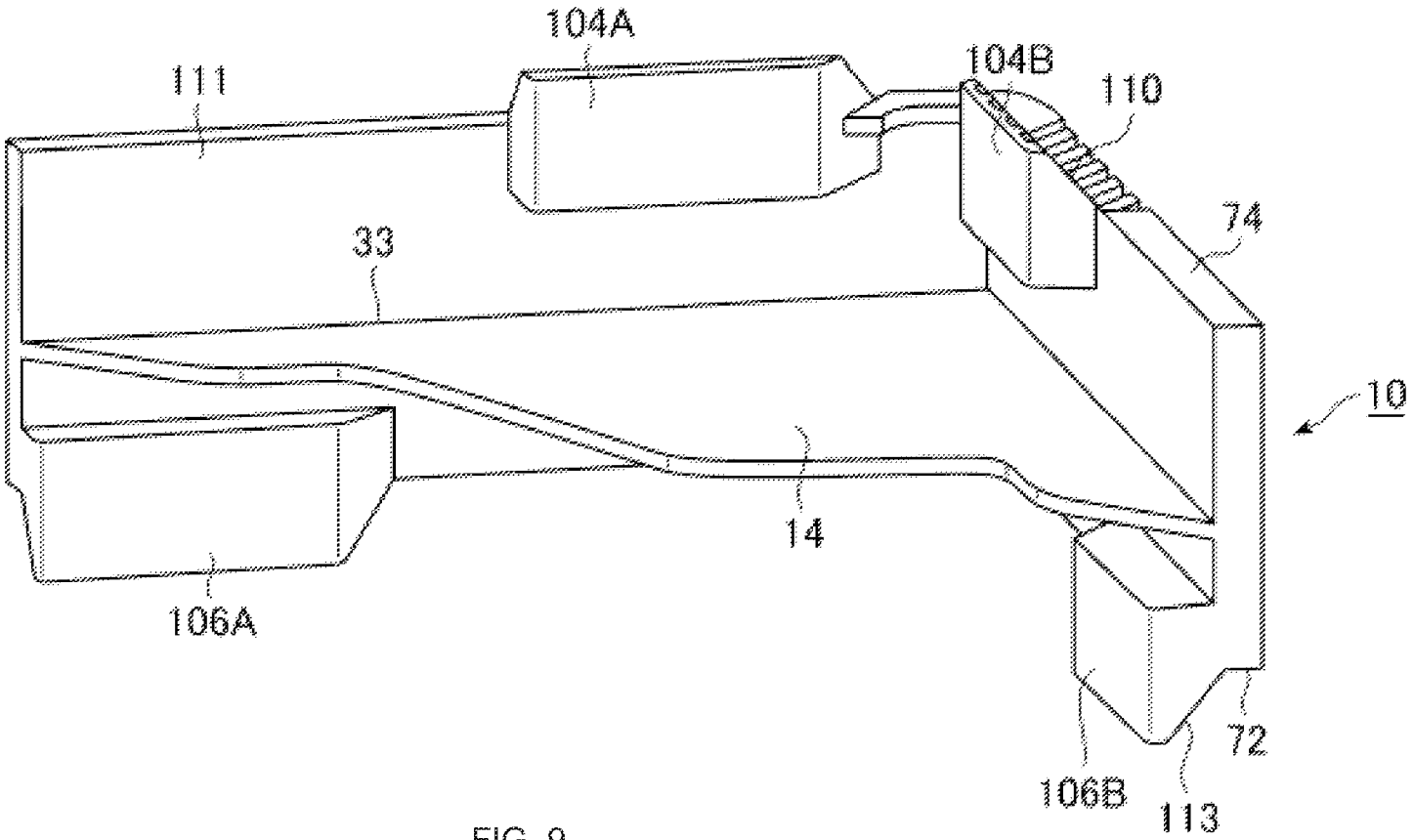
FIG. 9 is figure similar to FIG. 1 of module 10 used to stack solar panel P that lies in the second embodiment of this invention.

The feature in this embodiment is in the supportive structure of solar panel P as showing in FIG. 9. In the first embodiment, the character section composed of inner side 111 of vertical wall 18 and upper plate 12 and lower plate 14 is used. The four corners of solar panel P are assumed to be put on support side having upper side of lower plate 14 in such trapped support form. In this embodiment, upper plate 12 is omitted though each four corners of solar panel P was trapped and supported.

In each four corners of sunlight panel P, solar panel P is pushed towards vertical wall 18 until it touches inner side 111 of vertical wall 18 corresponding to lateral side orthogonal to angle part of solar panel P. As for solar panel P, the lower side and each sides of the corner part are supported by inner side 111 corresponding to vertical wall 18 and support side of lower plate 14. As compared to the first embodiment, four corners of solar panel P are supported as free edge where it is put on support side of lower plate 14.

Frame is installed on rim part and four corners of frame are put on support side of lower plate 14. In this case, it differs from embodiment 1, since upper plate 12 is omitted, it is possible to apply to the frames of various thickness as long as it doesn't lie to the bottom of upper engaging portion 104.

On the other hand, when solar panel P is stacked up by using module 10, in the first embodiment, though it was possible to allot module 10 to each four corners of each solar panel P of the accumulation schedule beforehand without installing module 10 of each solar panel P on the palette used for transportation. In this embodiment, only since solar panel P is put on the support side of lower plate 14 of module 10, it is necessary to install module 10 of each solar panel P on the palette.

However, by stacking sunlight panel P from which module 10 is installed in each four corners, it is comparatively difficult to position the following module 10 corresponding to each module 10 of the highest edge on the palette at a time at the position that corresponds to each four corners of solar panel P on the palette, like the first embodiment when module 10 is stacked to the pillar-shaped. Sometimes some clearances (gutter) are demanded between modules 10, but in this embodiment, since such a clearance is unnecessary, the stability of module 10 formed to the pillar-shaped of the accumulation can be secured more.

Though the embodiments of this invention are explained in detail above, if there are skilled persons, various corrections or changes are possible in the range in which it doesn't deviate from the range of this invention.

For instance, in this embodiment, as for module 10 stacked in each four corners of thin plate panel P, though it is explained that upper engaging portion 104 and lower engaging portion 106 are installed on inner edge 102 of load transmission area, module 10 installed on outside edge of load transmission side can be adopted for upper engaging portion 104 and lower engaging portion 106.

In addition, in this embodiment, one or more sunlight panel P vertical direction stacking is used. Though it is stacked up in pillar-shaped in each four corners of two or more solar panels P by using the same module 10, without being limited to it since there is a lot of number of sheets of sunlight panel P that supports module 10 of the lower layer and since the amount strength is demanded, module 10 with different thickness is prepared though externals are the same. Module 10 with more thickness than lower layer module 10 can be adopted.

EXPLANATION OF REFERENCE NUMBERS

P Solar panel
PC Palette
W Width
α Angle of inclination
10 Module
12 Upper plate
14 Plate
18 Vertical wall
20 Outer side
37 Upper side
39 Lower side
40 Strengthening ribs
43 Strengthening ribs
49 Lower edge
94 End face
95 End face
102 Inner edge
103 Inner edge
104 Upper engaging portion
106 Lower engaging portion
108 Intersection part

110 Inclination part
113 Inclination part
130 Dent

What is claimed is:

1. A module for use in stacking thin plate panels, comprising:

a supporting portion adapted to support a corner of a thin plate panel from below so that the module is, in combination with other modules, adapted to support the thin plate panel as a whole;

a load transmitting portion, connected to the supporting portion on an outside thereof, for transmitting the weight of the thin plate panels supported by the supporting portion; and a positioning portion for positioning the thin plate panels in the horizontal direction, wherein the load transmitting portion includes a L-shaped load receiving surface formed on an upper portion of the module and a L-shaped load releasing surface formed on a lower portion of the module, and in a mode in which the L-shaped load releasing surface of an upper module is mounted on the L-shaped load receiving surface of a lower module, upon stacking the upper module on the lower module, the positioning portion is provided with at least one upper projecting portion that is provided inwardly from an inner edge of the L-shaped load receiving surface, and is formed on each side of an intersecting portion of said L-shaped load receiving surface, and at least one lower projecting portion located on each side of said L-shaped load releasing surface that is provided inwardly from an inner edge of said L-shaped load releasing surface so as to be offset from a corresponding upper projecting portion of the lower module, whereby said at least one upper projecting portion of the lower module and said at least one lower projecting portion of the upper module cooperate with each other to limit a relative movement of the upper module to the lower module in both inward and outward directions.

2. The module for use in stacking thin plate panels according to claim 1, wherein the supporting portion has an upper plate member, a lower plate member, and a longitudinal wall that connects an outer edge of the upper plate member and an outer edge of the lower plate member in such a manner as to form a substantially U-shaped cross section together with the upper plate member and the lower plate member so that by inserting thin plate panels through an opening of the U-shaped cross section between the lower plate member and the upper plate member, a sandwiched supporting process is carried out, and the L-shaped load receiving surface is formed on an upper portion of the longitudinal wall, and the load releasing surface is formed on a lower portion of the longitudinal wall.

3. The module for use in stacking thin plate panels according to claim 1, wherein the upper projecting portion limits the upper module from shifting inward relative to the lower module, while the lower projecting portion limits the upper module from shifting outward relative to the lower module.

4. The module for use in stacking thin plate panels according to claim 2, the longitudinal wall having a solid structure.

5. The module for use in stacking thin plate panels according to claim 3, wherein the upper projecting portion includes a slanting portion that slants from the L-shaped load receiving surface upward in and away from the inner edge of the load receiving surface inward.

6. The module for use in stacking thin plate panels according to claim 3, wherein the lower projecting portion includes a slanting portion that slants from the L-shaped load releasing surface downward and away from the inner edge of the load releasing surface.

7. The module for use in stacking thin plate panels according to claim 5, wherein the slanting portion has a slanting angle in a range from 20 degrees to 70 degrees relative to a vertical line perpendicular to a plane of the upper plate member.

8. The module for use in stacking thin plate panels according to claim 6, wherein the slanting portion has a slanting angle in a range from 20 degrees to 70 degrees relative to a vertical line perpendicular to a plane of the upper plate member.

9. The module for use in stacking thin plate panels according to claim 2, wherein the upper projecting portion and the lower projecting portion cooperate with each other so as to cover substantially the entire inner edge of the longitudinal wall.

10. The module for use in stacking thin plate panels according to claim 5, wherein the longitudinal wall has an L shape on a horizontal cross section thereof.

11. The module for use in stacking thin plate panels according to claim 10, wherein the upper projecting portion is formed on a closer side to each intersecting portion of the L-shaped load receiving surface, and the lower projecting portion is formed on a far side from each intersecting portion of the L-shaped load releasing surface.

12. The module for use in stacking thin plate panels according to claim 1, wherein the thin plate panels are solar light panels each having a rectangular shape.

13. The module for use in stacking thin plate panels according to claim 1, wherein the module is made of resin, and integrally molded.

14. A method for stacking thin plate panels, comprising the steps of:

preparing a module including a supporting portion adapted to support a corner or a middle portion of a side of a thin plate panel from below so that the module is, in combination with other modules, adapted to support the thin plate panel as a whole, a load transmitting portion for transmitting the weight of the thin plate panels, the load transmitting portion connected to the supporting portion and provided with a load receiving surface on its upper portion and a load releasing surface on its lower portion, and a positioning portion for positioning the thin plate panels in a horizontal direction by using at least one upper projecting portion that is provided inwardly from an inner edge of the load receiving surface and at least one lower projecting portion that is provided inwardly from an inner edge of said load releasing surface so as to be offset from said at least one upper projecting portion in the horizontal direction; and sequentially stacking a plurality of thin plate panels in a manner so as to stack the modules in a pillar shape, with each of the thin plate panels being allowed to transmit the weight thereof through the load transmitting portion at each of the corner or the middle portions, wherein the step of sequentially stacking further comprises positioning the upper thin plate panel in the horizontal direction relative to the lower thin plate, by limiting a relative movement of the upper module to the lower module in the horizontal direction by using the at least one upper projecting portion of the lower module and the at least one lower projecting portion of the upper module between vertically adjacent modules at each of the corner or the middle portions.

15. The method for stacking thin plate panels according to claim 14, comprising the steps of:

preparing the supporting portion that further includes an upper plate member, a lower plate member, and a longitudinal wall that connects an outer edge of the upper plate member and an outer edge of the lower plate member in a manner so as to form a substantially U-shaped cross section together with the upper plate member and the lower plate member; and prior to the step of sequentially stacking, fitting the module to four corners of a plurality of thin plate panels, wherein the step of fitting further comprises inserting the thin plate panels between the lower plate member and the upper plate member so as to be sandwiched and supported therein from an opening portion of the U-shaped cross section, and the step of sequentially stacking further comprises successively stacking the thin plate panels in a manner so as to stack the modules in a pillar shape in a longitudinal direction, with each of the thin plate panels being allowed to transmit the weight thereof in a longitudinal direction through the load transmitting portion at each of the four corner portions, with respect to the thin plate panels whose four corners are fitted to the module.

16. The method for stacking thin plate panels according to claim 14, further comprising the steps of:

preparing the load transmitting surfaces that include a load receiving surface formed on an upper portion of a longitudinal wall and a load releasing surface formed on a lower portion of the longitudinal wall; and preparing the projecting portions in such a manner as to offset the lower projecting portion from the corresponding upper projecting portion in the horizontal direction, and limit the upper module from shifting relative to the lower module, wherein upon mounting the load releasing surface of the upper module on the load receiving surface of the lower module, at the corner portions, a positioning step is carried out by engaging the lower projecting portion of the upper module with the inner edge of the load receiving surface of the lower module, and engaging the upper projecting portion of the lower module with the inner edge of the load releasing surface of the upper module.

17. The method for stacking thin plate panels according to claim 16, comprising the steps of:

preparing the upper projecting portion with a slanting portion that slants from the load receiving surface upward and away from the inner edge of the load receiving surface; and preparing the lower projecting portion with a slanting portion that slants from the load releasing surface downward and away from the inner edge of the load releasing surface, wherein the step of sequentially stacking further comprises stacking the upper module on the lower module, with the slanting portion of the upper projecting portion and/or the lower projecting portion being used as a guide surface.

18. The module for use in stacking thin plate panels according to claim 2, wherein the upper plate member is formed directly below a lower end of the upper projecting portion, and the lower plate member is formed directly above an upper end of the lower projecting portion, and the thin plate panel is prepared as a panel with no frame being formed on the peripheral edge thereof, so that each of four corners of the panel is directly sandwiched and supported by the modules.

19. The module for use in stacking thin plate panels according to claim 1, wherein the supporting portion is a plate member having a supporting surface on the upper surface thereof, and the thin plate panel, having four corners and being a panel with a frame formed on the peripheral edge thereof, said thin plate panel being configured to be mounted in contact with the inner surface of the longitudinal wall, with each of four corners of the panel in contact with an inner surface of the supporting surface with the frame interposed therebetween.

20. The module for use in stacking thin plate panels according to claim 12, wherein each of the L-shaped load receiving surface and the L-shaped load releasing surface has a width of 15 mm or less.

* * * * *